US006413055B1

(12) United States Patent
Geringer et al.

(10) Patent No.: US 6,413,055 B1
(45) Date of Patent: Jul. 2, 2002

(54) SWASHPLATE POSITION ASSIST MECHANISM

(75) Inventors: Kerry G. Geringer; Dennis M. Greene, both of Ames; Jeff L. Herrin, Ankeny; Richard L. Otto, Marshalltown, all of IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/776,554

(22) Filed: Feb. 2, 2001

(51) Int. Cl.[7] ..... F04B 1/26

(52) U.S. Cl. ..... 417/222.1; 417/270; 417/269; 417/53; 91/505; 91/504; 91/499; 91/12.2; 60/468

(58) Field of Search ..... 417/222.1, 270, 417/269, 53; 91/505, 504, 499, 12.2; 60/468

(56) References Cited

U.S. PATENT DOCUMENTS 3,332,323 A * 7/1967 Roeske ..... 415/901
3,585,901 A 6/1971 Moon, Jr. et al.
4,145,887 A * 3/1979 Meijer ..... 60/517
4,480,963 A * 11/1984 Ring ..... 417/216
4,550,645 A 11/1985 Beck, Jr.
5,122,037 A * 6/1992 Myers et al. ..... 417/222.1
5,160,245 A 11/1992 Geringer
5,205,201 A * 4/1993 Gollner ..... 60/444
5,423,183 A 6/1995 Folsom
5,486,142 A 1/1996 Folsom
5,493,862 A 2/1996 Folsom
5,535,589 A 7/1996 Folsom
5,567,123 A * 10/1996 Childress et al. ..... 417/222.1
5,575,152 A 11/1996 Folsom
5,678,405 A 10/1997 Folsom
5,794,515 A * 8/1998 Bethke ..... 91/506
6,033,188 A * 3/2000 Baldus et al. ..... 417/222.1
6,119,456 A * 9/2000 Louis et al. ..... 60/443

* cited by examiner

*Primary Examiner*—Charles G. Freay
*Assistant Examiner*—Emmnuel Sayoc

(57) ABSTRACT

A swashplate assist mechanism for dynamically varying swashplate moments in a multiple piston hydraulic unit includes a valve means disposed in the swashplate and defining a variable orifice for metering fluid from at least one of the pistons; and means for generating a control error signal to the valve means so as to adjust the size of the variable orifice based upon the control error signal. When fluid is metered from a leading piston to a trailing piston near one or more of the pressure transition zones, or when fluid is metered from a trailing piston to a leading piston near the opposite transition zones, the swashplate moments can be reduced.

25 Claims, 8 Drawing Sheets

SWASHPLATE POSITION ASSIST MECHANISM

BACKGROUND OF THE INVENTION

The present invention relates to the field of hydraulics. More particularly, this invention relates to a "servoless" assist mechanism for altering the forces required to position the swashplate of a hydrostatic unit such as a pump or motor. In general, the mechanism can be used to reduce the force and energy levels required to position the swashplate in axial piston pumps and motors. The mechanism is particularly useful in applications where operator "feel" is important, allowing the operator to feel feedback from the vehicle but at reduced force levels. The mechanism provides a dynamic or variable method of affecting or tuning net swashplate moments.

Hydrostatic transmissions have been used in skid steer loaders for a number of years now. In the early days of hydrostatically propelled skid steer loaders, the machines were relatively small and therefore the operator could manually directly control the position of the swashplate and the resulting displacement of the hydraulic unit through mechanical linkage with minimal force and fatigue. As the machines have become larger in recent years, the power and force levels have become too large for the operator to handle without tiring when operating the machine for an extended period of time. Servo-controlled transmissions were developed to overcome the operator fatigue problem, but the operators then felt "disconnected" from the machine when attempting to control its displacement or swashplate position. The servo control devices require additional power and suffer reduced response capability, especially when response is needed most such as when the machine is near neutral, has low displacement, or is inching.

Various tiltable swashplate arrangements are known for varying displacement in axial piston pumps and motors. In one arrangement, the swashplate has opposite cylindrical trunnions that pivotally mount or journal it in the pump or motor housing. A plurality of pistons slidably mount in corresponding piston bores or chambers arranged in a circular pattern in a rotatable cylinder block that is urged by a block spring toward the tiltable swashplate. A valve plate engages the end of the cylinder block that is remote from the swashplate. Slippers swivelingly attached to the pistons engage a running surface on the swashplate as the cylinder block rotates. If the running surface of the swashplate is perpendicular to the longitudinal axes of the pistons, the pistons do not reciprocate in the cylinder block and no fluid is displaced or consumed by the hydraulic unit. A lubrication hole typically extends longitudinally through the piston and slipper so that oil from the piston bore or chamber can reach the slipper running surface of the swashplate.

When the swashplate is forcibly tilted away from perpendicular, the pistons reciprocate in the piston bores as the pistons are driven in a circle against the inclined plane. This reciprocating action means that the chambers of the pistons on one region of the swashplate are under high pressure, while the piston chambers on the opposite region of the swashplate are under low pressure. Each piston bore or chamber in the cylinder block has a "pressure profile" associated with it as the block rotates. The pressure times the area translates into a force, which yields a moment on the swashplate. To move or maintain the swashplate tilted to given degree, a moment of equal and opposite magnitude must be maintained on the swashplate. The operator does this manually by applying a force on a lever or torque on a handle attached to the swashplate or through a conventional servo mechanism. If a servo mechanism is used, operator "feel" is usually lost.

One common method of fine tuning or affecting swashplate moments in a hydrostatic unit is a static method involving designing a specific valve plate with a specific fixed porting configuration to achieve the desired swashplate moments. A valve plate is a substantially flat disc-shaped annular ring of material that is fixed against rotation on the end cap of the hydraulic unit adjacent the rear surface of the rotating cylinder block (which is opposite of the swashplate). The conventional valve plate typically has an arcuate inlet port and an arcuate outlet port formed therethrough on opposing sides of a median axis. These ports reside along arcs that generally align with the pitch circle of the piston bores in the cylinder block. Thus, the inlet and outlet ports generally register with the circular path of the reciprocating pistons as the pistons rotate with the cylinder block against the valve plate. The inlet and outlet ports are angularly spaced apart in the areas or zones where the reciprocating pistons change their direction of reciprocal movement or transition from high pressure to low pressure and vice versa. The top dead center (TDC) and bottom dead center (BDC) positions of the reciprocating pistons generally correspond to these transition zones. The spacing of the inlet and outlet ports of the valve plate depends to some extent on the number of pistons in the rotating cylinder block assembly. Some existing valve plates utilize specially shaped notches, such as "rat tails" or "fish tails," at the entrance and/or exit of the ports (i.e.—in the transition zones) to affect the swashplate moments. Moon et al. U.S. Pat. No. 3,585,900 teaches the basics of utilizing valve plate fish tails to affect swashplate moments in axial piston hydraulic units. U.S. Pat. No. 4,550,645 teaches some additional geometric configurations for fish tails and valve plates. Unfortunately, many different valve plates are required to satisfy the swashplate moment demands of the various users. Thus, the number of valve plate designs tends to proliferate and it can be costly to produce and warehouse an adequate selection of valve plates. Furthermore, if a change in swashplate moments is desired, the user must physically disassemble the unit and change the valve plate. Finally, the valve plate configuration is essentially constant or static once a particular valve plate is selected and installed. A valve plate configuration may have beneficial effects on the swashplate moments, performance and controllability of the unit at under certain operating conditions (including but not limited to speed, pressure and displacement), but the same valve plate configuration may have undesirable effects under other conditions within the normal operating range of the unit. Since the valve plate geometry is fixed based upon the valve plate chosen, the user must accept the tradeoffs involved. Careful and elaborate optimization analysis is often required to determine the best valve plate design for the task.

Thus, there is a need for dynamic rather than static means and methods for affecting swashplate moments. There is also a need for a means and method for affecting swashplate moments that does not necessarily involve valve plate design changes or valve plate proliferation.

Therefore, a primary objective of the present invention is the provision of a dynamic means and method for affecting swashplate moments in a hydraulic unit.

Another objective of this invention is the provision of a variable means of affecting swashplate moments throughout the normal operating range of operating conditions of the hydraulic unit.

Another objective of this invention is the provision of a means for reducing net swashplate moments in a manually controlled hydraulic unit to reduce operator fatigue without sacrificing the feel of operator feedback.

Another objective of this invention is the provision of a means for generating a control error signal to a variable orifice valve for bleeding fluid between adjacent pistons to affect bore pressure and subsequently swashplate moments.

Another objective of this invention is the provision of means for varying swashplate moments without the need for changing valve plates in a hydraulic unit.

These and other objectives will be apparent from the drawings, as well as from the description and claims that follow.

SUMMARY OF THE INVENTION

The present invention relates to a swashplate assist mechanism for dynamically varying swashplate moments in a multiple piston hydraulic unit. The mechanism includes a valve means disposed in the swashplate and defining an adjustable variable orifice for metering fluid from at least one of the pistons; and means for generating a control error signal to the valve means so as to adjust the size of the variable orifice based upon the control error signal.

This invention provides a plurality of holes in the swashplate running surface and fluidly connects them to a spool valve to meter high-pressure fluid from a leading piston to a trailing piston near one or more of the pressure transition zones so as to reduce swashplate moments.

In one embodiment, two pairs of angularly spaced holes are provided at or near the transition areas at top dead center (TDC) and/or bottom dead center (BDC) of the piston's reciprocation. A canned spring arrangement connects the control handle to the swashplate so as to yield a control error that is a function of the torque on the swashplate once the preload on the canned spring is exceeded. The control error signal is then transmitted to variable orifice valves that meter oil between a leading piston and a trailing piston to affect the swashplate moments of the unit. The valve can take many forms, including the three-position, three-way spool valve disclosed herein. The invention is adaptable to either manually controlled or servo-assisted units.

DETAILED DESCRIPTION OF THE PREFERRED EMBODIMENT(S)

Figure 1:
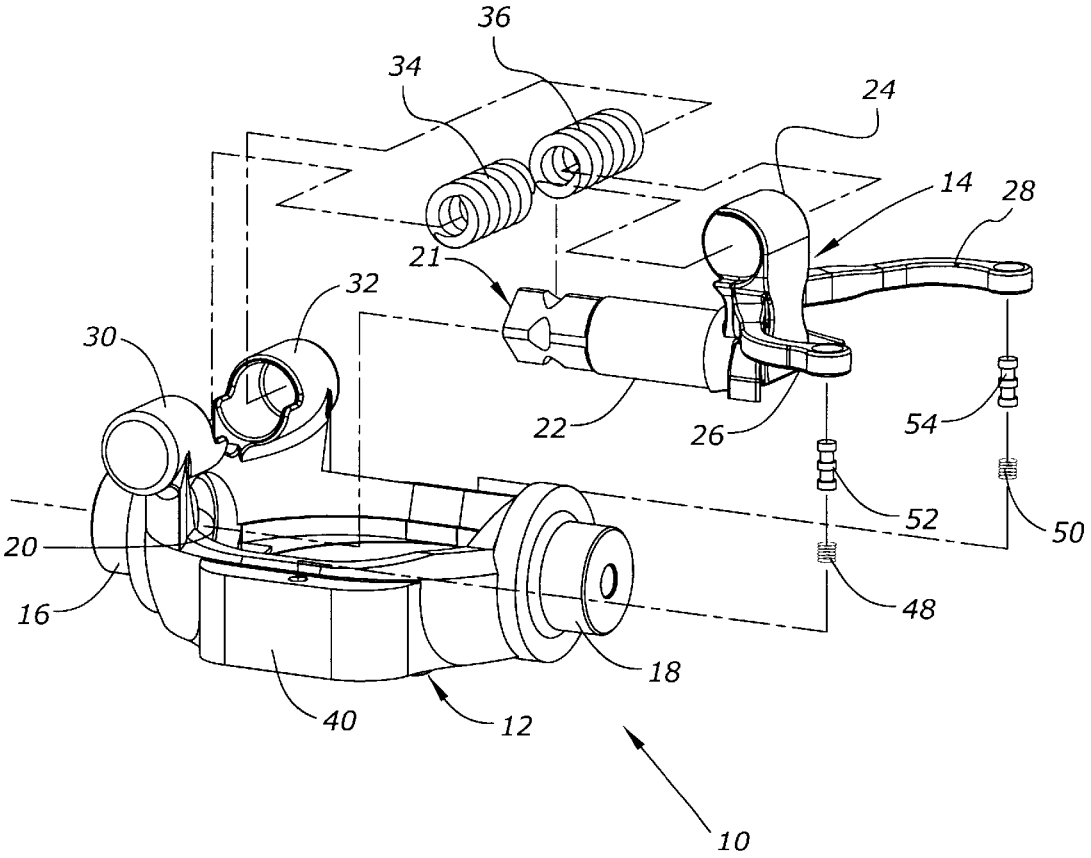
FIG. 1 is an exploded assembly view of one embodiment of the swashplate assist mechanism of this invention.

The servoless assist mechanism of this invention includes two basic components: an error signal generating means and a variable orifice valve means for metering fluid between adjacent pistons in response to the error signal. Both means are associated with the swashplate assembly of the hydrostatic unit. FIG. 1 discloses one embodiment of the swashplate assembly of this invention, which is designated by reference numeral 10. The swashplate assembly 10 has a swashplate main body 12 and a swashplate handle member 14. The swashplate main body 12 pivotally mounts to the housing (not shown) of the hydrostatic unit and is therefore tiltable or can pivot about the central axis 15 of trunnions 16, 18. The axis 15 is also referred to herein as the tilt axis of the swashplate assembly 10. A bore 20 extends through the trunnion 16 along the tilt axis 15.

The swashplate handle member 14 includes a handle 21 that has a cylindrical shaft portion 22 thereon. The shaft portion 22 pivotally mounts or rotatably journals in the bore 20 of the main body 12. In the embodiment shown, the handle member 14 is generally Y-shaped and includes a pair of curved actuating arms 26, 28 extending therefrom in a wishbone-shaped arrangement. A spring stop member 24 protrudes radially outward from the shaft portion 22 adjacent its junction with the arms 26, 28. As will be understood from the description below, a canned spring means couples the handle member 14 with the main body 12. Opposing stop members 30, 32 extend upwardly from the main body 12 and are disposed approximately equal distance from the centerline of the bore 20 and the shaft 22 (i.e.—the tilt axis 15). Coiled compression springs 34, 36 are located between the stop members 30, 24 and 24, 32 respectively when the handle member 14 is inserted through the bore 20. The springs 34, 36 share a common central longitudinal axis and bias the handle member 14 into a given angular position relative to the main body 12.

Figure 2:
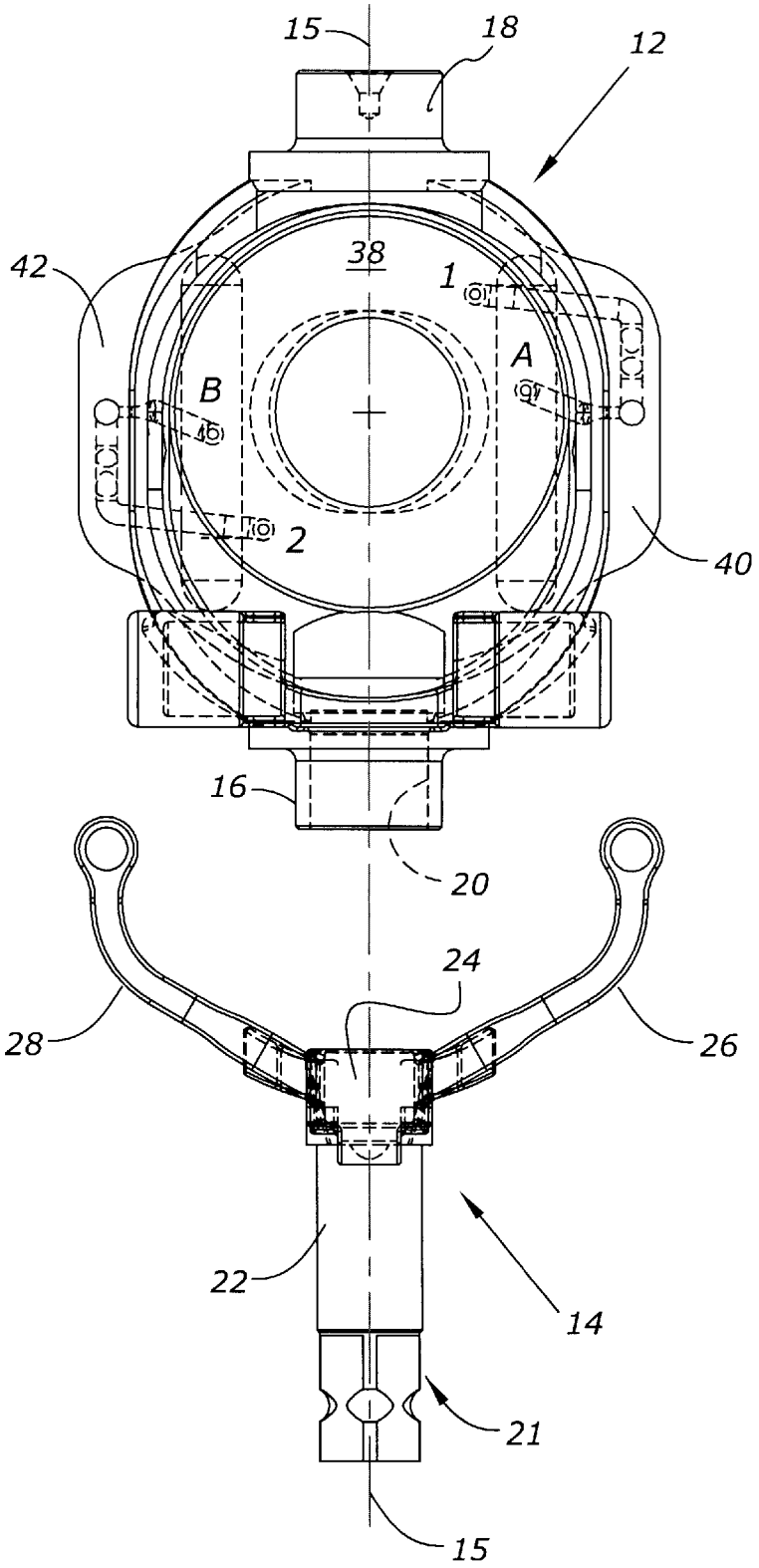
FIG. 2 is a top plan view of some of the major components of the swashplate assembly for the embodiment of FIG. 1.

As best seen in FIGS. 1 and 2, the swashplate main body 12 includes an annular, substantially flat planar slipper running surface 38 that is substantially parallel to the tilt axis 15. Raised flange portions or ears 40, 42 extend above the running surface 38 and are disposed on opposite sides of the tilt axis 15. Spool bores 44, 46 extend into the ears 40, 42 respectively as shown in FIGS. 1–4. The bores 44, 46 are blind or dead ended bores and therefore have a bottom wall 47. The bores 44, 46 reside radially outward of the surface 38 and extend perpendicular thereto. Springs 48, 50 rest on the bottom walls 47 and urge valve spools 52, 54 that are slidably disposed in the spool bores 44, 46 respectively into engagement with the actuating arms 26, 28 respectively. Springs 34, 36 urge the arms 26, 28 into a horizontal position so that the valve 80 is normally in the closed, central position.

Figure 4:
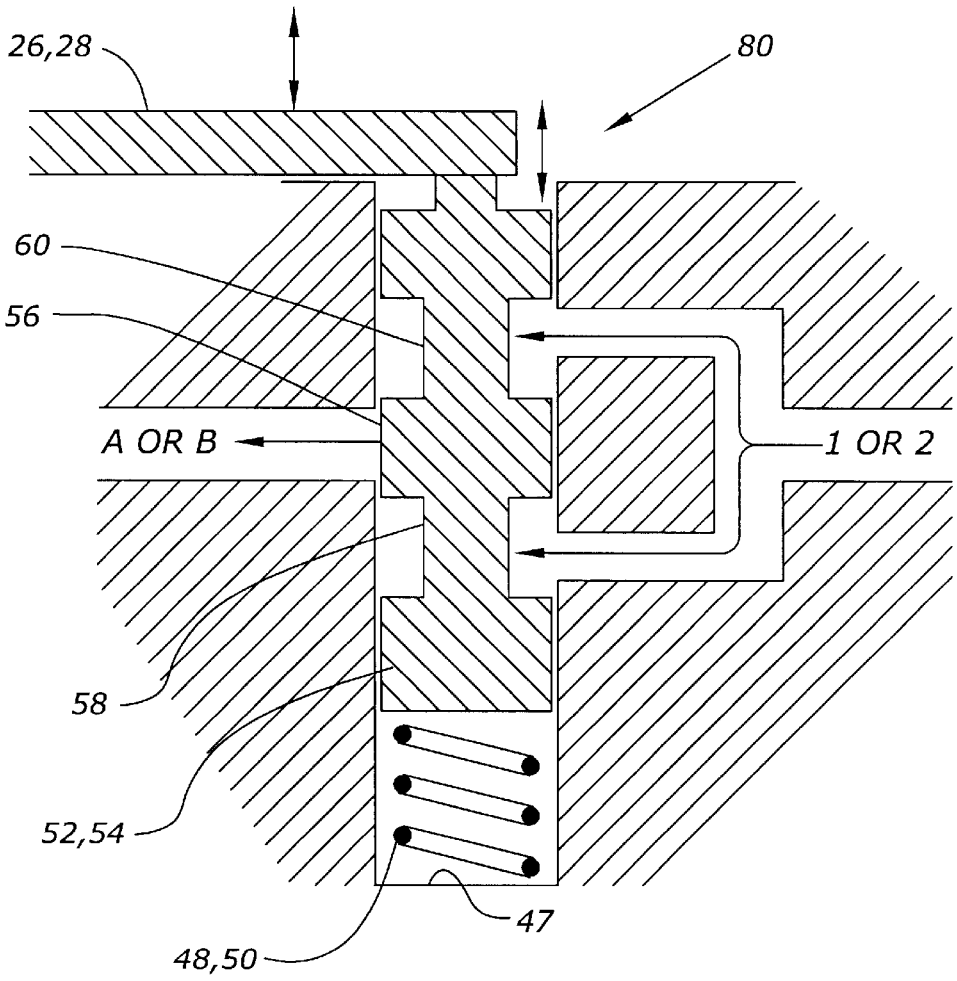
FIG. 4 is a simplified cross-sectional view of the variable orifice valve component of the swashplate assembly of FIG. 1.
Figure 5:
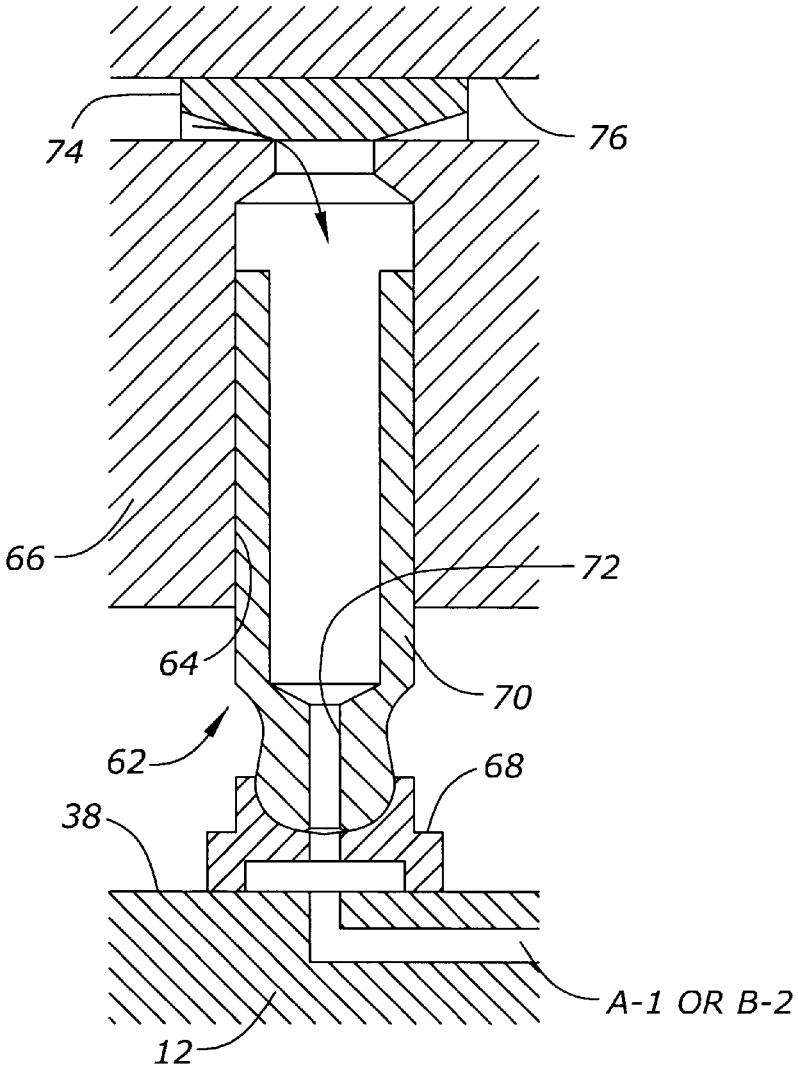
FIG. 5 is a longitudinal cross-sectional view of the piston chamber and the surrounding components as they relate to the swashplate of the present invention.

In FIG. 4, the spools 52, 54 each have a sealing land 56 between two annular grooves 58, 60. The sealing land 56 has a length along the longitudinal axis of the spool that is sufficient to completely block fluid flow between passages A, B and 1, 2 formed in the swashplate main body 12. The fluid passages A, B and 1, 2 intersect or are in fluid communication with the slipper running surface 38 as shown in FIGS. 2 and 5. The fluid passages A, B and 1, 2 also intersect their respective spool bores 44, 46 as shown in FIG. 4. The passages 1 and 2 have branches that align with the grooves 58, 60 of their respective spools 52, 54 so that flow takes place when the spool 52, 54 moves in either direction away from its closed, central position.

FIG. 5 discloses a typical axial piston structure for a hydrostatic unit equipped with this invention and explains why the fluid passages A, B and 1, 2 advantageously begin and exit on the slipper running surface 38 of the swashplate body 12. In a typical axial piston hydraulic unit, oil is displaced or consumed through the reciprocating action of a plurality of piston assemblies 62 and piston bores 64 arranged in a circular pattern in a rotatable cylinder block 66. The piston assembly 62 includes a slipper 68 attached via a ball and socket connection to a piston 70. The lower portion of the piston 70 is generally hollow and a fluid passage 72 extends through the piston and through the center of the slipper in a conventional manner for lubrication and balancing of the slipper 68.

The swashplate 12 of this invention provides fluid passages A, B and 1, 2 whose exits and entrances on the surface 38 are arranged roughly the same radial distance from the center of the swashplate 12 as the piston bores 64 are from the center of the cylinder block 66. The sets of angularly adjacent fluid passages A, 1 and B, 2 are spaced apart the approximately same angular distance as the distance between pistons 70 in the cylinder block 66. For example, the passages A and 1 or B and 2 are approximately forty degrees apart if the hydraulic unit has nine equally spaced pistons. The passages A, 1, B, 2 come into fluid communication with the passage 72 in the slipper 68 as each piston 70 rotates with the cylinder block 66. One passage A, B connects with a leading piston 70, while the other adjacent passage 1, 2 in the pair connects to a trailing piston 70. Thus, the valve spools 50, 52 control the bridge or act as variable orifices between the leading and trailing pistons.

The present invention functions independently from the valve plate 74 installed in the unit. The valve plate 74 is on the opposite end of the cylinder block 66 from the swashplate assembly 10. As is conventional, the valve plate 74 is mounted on the end cap 76 and is pinned in place thereon so as to remain stationary while the cylinder block 66 rotates against it.

In operation, the user applies a force (torque) on the handle 21 of the swashplate handle member 14. Unless the biasing force of the springs 34, 36 is overcome, the main body 12 of the swashplate moves with the swashplate handle 14 and the operator "feels" force feedback from the hydraulic unit. When the torque input by the operator is greater than the spring force or the feedback from the unit exceeds the torque applied by the operator, the trunnion arms 26, 28 move with respect to the main body 12 of the swashplate assembly 10. The spools 52, 54 situated below the trunnion arms 26, 28 are displaced accordingly and the valve means 80 ports or meters oil from one piston chamber or bore 64 to another through the holes A, B, 1, 2 in the swashplate. The net swashplate moments are reduced to bring the forces on the swashplate assembly back into balance. The swashplate body, handle, canned spring, and actuating arm arrangement constitutes a means for generating a control error signal. With the means shown, the control error signal is proportional to the input torque applied to the swashplate assembly 10. Thus, greater assistance in moving or holding swashplate position occurs where the operator needs it most. The control error signal could be generated by various other means without detracting from the invention. These alternative means include but are not limited to strain gauges, a torsion spring, a torsion bar, electronic feedback at the control handle, and magnetic field sensors to detect relative motion.

Figure 3:
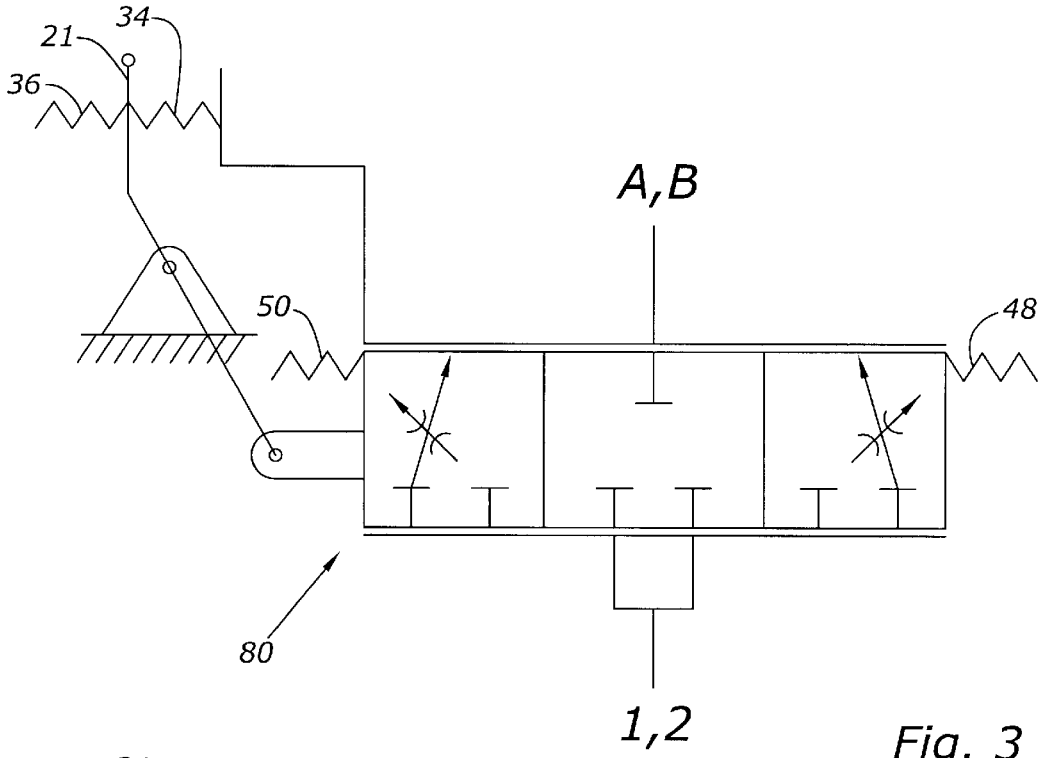
FIG. 3 is a simplified schematic diagram of the three-position, three-way valve disposed in the swashplate assembly of the embodiment of FIG. 1.
Figure 6:
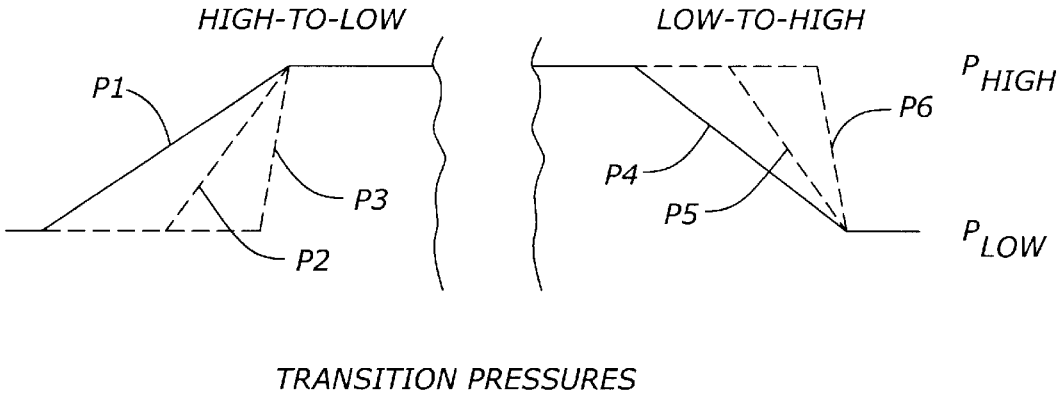
FIG. 6 is a graphical representation of piston chamber pressures in the transition zones and illustrates the variability of responses possible with this invention.

At both transition zones, fluid from a leading piston is metered to a second trailing piston as a function of the control error signal. The pressure characteristic in each transition zone is influenced by the orifice bridge created between the leading and trailing piston and the fluid that is metered between the pistons via the 3-position 3-way valve 80 (FIG. 3). The effects of the present invention on the transition pressures and piston pressure profiles are shown in FIGS. 6 and 7, respectively.

For example, the curve P1 represents the high-to-low transition when its variable orifice valve is closed for minimal flow. For stability or other reasons, some leakage or minimal flow may be desired through the variable orifice valve, even when it is in a "closed" position. The curve P2 represents the same transition when the variable orifice is partially open. The curve P3 represents the high-to-low transition when the variable orifice valve is fully open. Of course, the actual curve can be varied anywhere between P1 and P3, depending on the control error signal. Likewise, the curves P4, P5, and P6 represent the low-to-high transitions when the other variable orifice valve is closed for minimal flow, partially open, and fully open respectively. In the preferred embodiment shown, the size of the orifice and therefore the movement of the curve is directly proportional to the control error signal. The larger the error signal, the more the orifice will open.

Figure 7:
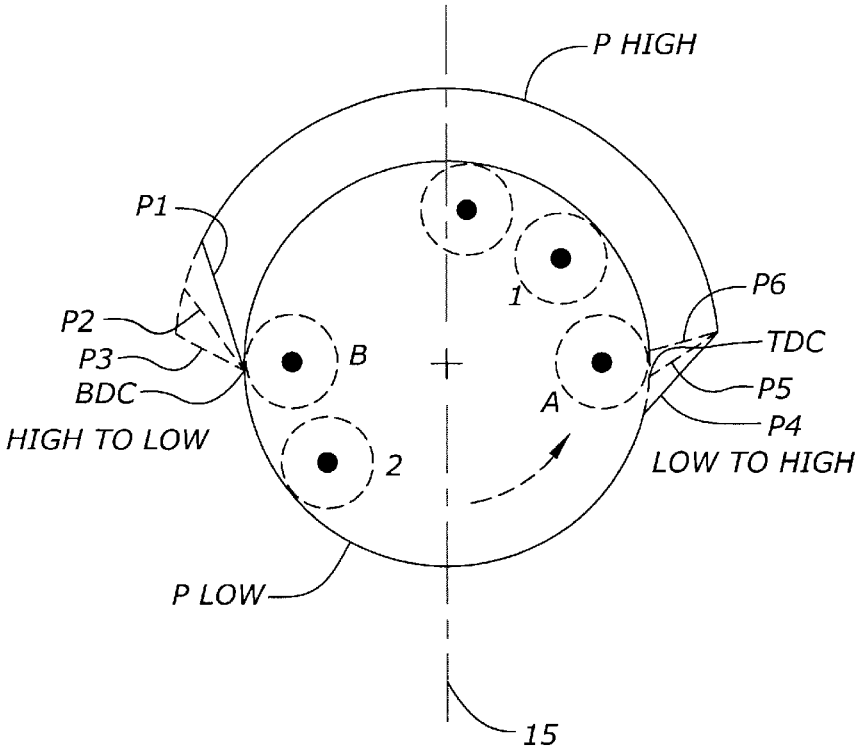
FIG. 7 is a diagram illustrating how dynamic fine tuning of swashplate moments is made possible by the present invention, which can vary the pressure profile of a particular piston chamber as the piston rotates with the cylinder block and passes through a pressure transition zone.

FIG. 7 illustrates the impact these pressure profile shifts can have on the net swashplate moment about the tilt axis 15. The areas under the pressure profile curve on either side of the tilt axis 15 (or in this case, both sides together) can be varied to affect the net swashplate moment about the axis 15. Thus, the timing and slope of pressure curves can be shifted so as to reduce the moments required to move and maintain the position of the swashplate, which greatly reduces operator fatigue.

Figure 1A:
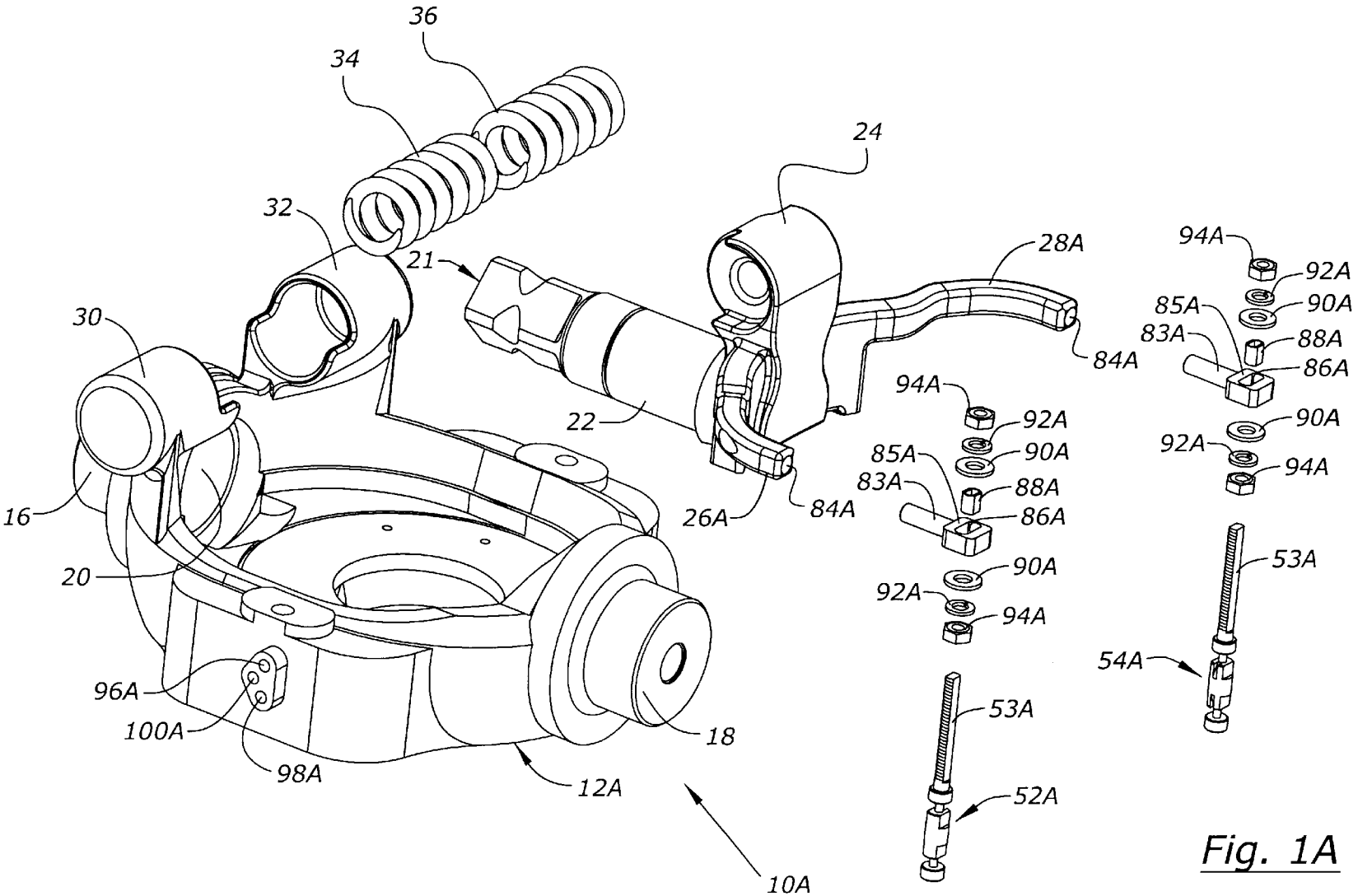
FIG. 1A is an exploded assembly view of another embodiment of the swashplate assist mechanism of this invention.
Figure 3A:
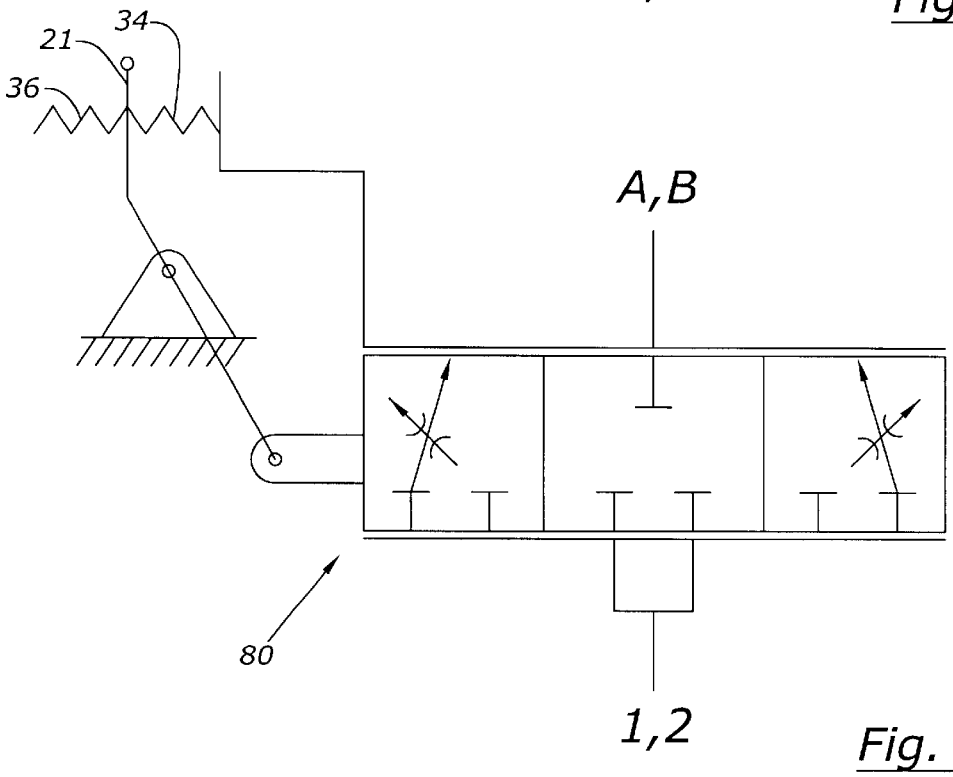
FIG. 3A is a simplified schematic diagram of the three-position, three-way valve disposed in the swashplate assembly of the embodiment of FIG. 1A.
Figure 4A:
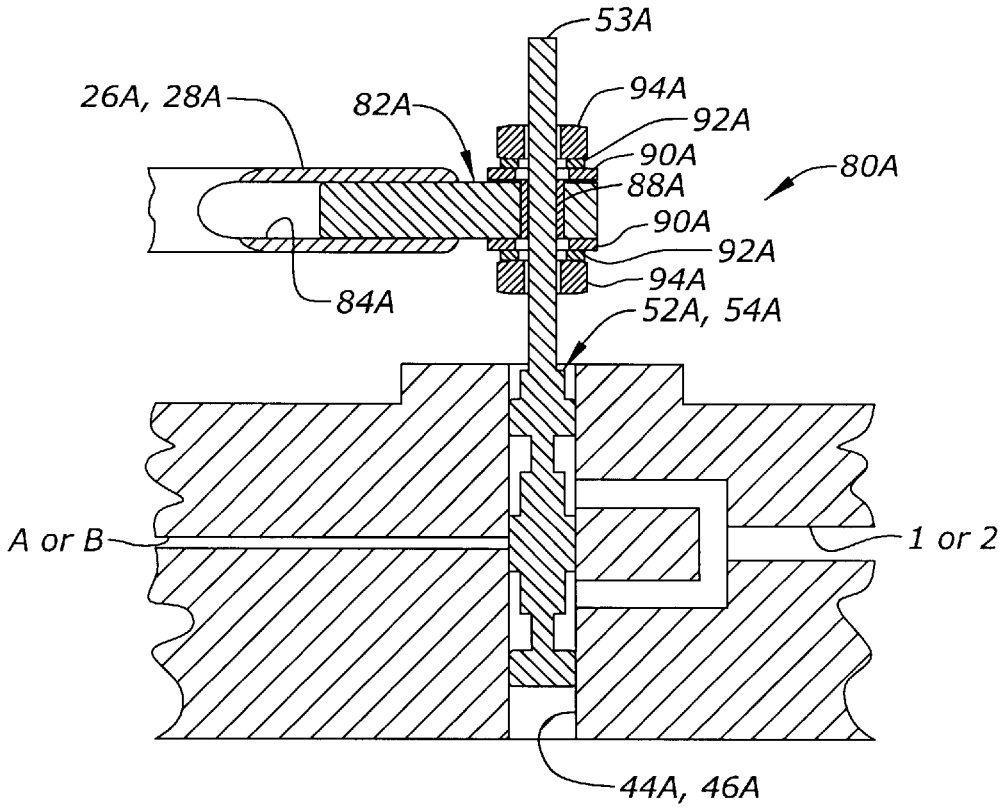
FIG. 4A is a simplified cross-sectional view of the variable orifice valve component of the swashplate assembly of FIG. 1A.

A second embodiment of this invention appears in FIGS. 1A, 3A and 4A. Components or features that are identical to those in the first embodiment are designated by identical reference numerals. Similar functional components or features are designated by similar reference numerals. The spools 52A, 54A each have a threaded tang 53A that is adjustably secured to the actuating arms 26A, 28A by pivotal attachment members 82A. The threaded tang 53A has a pair of opposing planar parallel sides and opposing curved threaded sides as shown.

At one end the pivotal attachment member 82A has a round pin portion 83A that slidably mates with a round hole 84A in the end of the actuator arm 26A or 28A. An enlarged flat tab or flange 85A resides at the other end of the attachment member 82A. A slot 86A extends through the flange 85A as shown.

A contact bearing 88A receives the threaded tang 53A and slidingly guides it in the slot 86A once washers 90A, lock washers 92A, and nuts 94A are installed on the tang 53A as shown in FIGS. 1A and 4A. The lower portion of the spool 26A, 28A is thus adjustably suspended for axial movement in the spool bore 44A, 46A.

Construction holes 96A, 98A and 100 extend laterally into the swashplate body 12 to help form the fluid passages A, B, 1, 2. The construction holes 96A, 98A, 100A are later sealed with appropriate conventional plugs (not shown).

The arrangement described above provides the necessary degrees of freedom to prevent any binding of the spool 52A, 54A in the bore 44A, 46A, which could be induced by a more rigid connection to the actuating arm 26A, 28A. The pin and round hole connection provides for axial and pivotal movement of the attachment member 82A while the slotted connection provides for some transverse misalignment of the spool with respect to the actuating arm.

The embodiment of FIG. 4 presents a number of advantages over the embodiment of FIG. 1. First, by having the spools attached to the actuating arms, there is no need for the springs 48, 50 to maintain contact between the spools and the arms. Compare FIG. 3A to FIG. 3. Without the need to support the springs 48, 50, the spool bores 44, 46 could be more simply fabricated as through holes 44A, 46A. Even though the embodiment of FIG. 4 requires more components than the embodiment at FIG. 1, the parts generally require less precision to manufacture and are therefore less costly.

Although the preferred embodiments shown and described above have two swashplate assist valves (actuating arms and spools), it will be appreciated by one skilled in the art that a single actuating arm and swashplate assist valve can be used if the effects of the invention are sought in only one of the transition zones.

The present invention provides a unique method of dynamically adjusting swashplate moments in a multiple piston hydrostatic unit by: 1) providing a fluid passage A, 1 or B, 2 in the swashplate so as to selectively fluidly connect a leading piston and a trailing piston; 2) providing a variable orifice in said fluid passage in the swashplate; and 3) adjusting the size of the variable orifice based upon a control error signal.

Another advantageous feature of this invention is that the spring interconnection of the swashplate main body 12 and the swashplate handle member 14 through springs 34 and 36 effectively provides a vibration isolator. In other words, the vibration of the swashplate is dampened and isolated from the operator interface with the manual actuator. In practice this is very desirable because this vibration, which is inherent in this type of hydrostatic unit, is quite objectionable to the operator. The vibration can, in extreme conditions, even induce numbness in the operator's hand.

Thus, it can be seen that the present invention at least satisfies its stated objectives.

What is claimed is:

1. A swashplate position assist mechanism for a hydrostatic unit including a swashplate assembly tiltable about a tilt axis and having a slipper running surface thereon, a rotatable cylinder block assembly with a plurality of piston bores therein, and a corresponding plurality of piston assemblies each including a slipper attached to a piston that axially reciprocates in one of the plurality of piston bores, a fluid passage extending through the piston assembly to the slipper running surface, the mechanism comprising:

a valve disposed in the swashplate assembly and defining a variable orifice for metering fluid from the fluid passage of at least one of the pistons; and means for generating a control error signal to the valve so as to adjust the size of the variable orifice based upon the control error signal.

2. The mechanism of claim 1 wherein the valve is a three-position three-way spool valve.

3. The mechanism of claim 2 wherein the valve has opposite first and second positions wherein the valve is at least partially open and is spring centered into a third position wherein fluid is blocked from being metered from said at least one of the pistons, the third position being located between the first and second positions.

4. The mechanism of claim 1 wherein the valve includes a pair of three-position three-way spool valves that move inversely with respect to each other in response to the control error signal.

5. The mechanism of claim 2 wherein the valve includes a spool movably mounted in a spool bore formed in the swashplate assembly, the bore has a continuous bottom wall, and at least one passage intersecting the bore above the bottom wall and being in fluid communication with the fluid passage in one of the piston assemblies.

6. The mechanism of claim 5 wherein the spool bore is disposed radially outward of and perpendicular to the slipper running surface.

7. The mechanism of claim 1 wherein the error signal is proportional to an input torque applied to the swashplate assembly.

8. The mechanism of claim 1 wherein the variable orifice has a first port in fluid communication with the fluid passage of a first piston assembly in a pressure transition zone and a second port in fluid communication with the fluid passage of a second piston assembly adjacent the first piston.

9. A swashplate position assist mechanism for a hydrostatic unit including a rotatable cylinder block assembly with a plurality of piston bores therein and a corresponding plurality of piston assemblies each including a slipper attached to a piston that axially reciprocates in one of the plurality of piston bores, a fluid passage extending through each of the piston assemblies, the mechanism comprising:

a swashplate assembly including a swashplate main body having a hole therein extending along a tilt axis and a swashplate handle member rotatably journaled in the hole and coupled with the main body by a spring such that the main body rotates with the handle member about the tilt axis when a sufficient torque is applied to the handle member to overcome a predetermined biasing force imposed by the spring;

the swashplate main body having an annular slipper running surface thereon parallel to the tilt axis and at least one orifice in fluid communication with the slipper running surface;

said orifice having an opening area that is variable and controlled by rotational movement of the handle member relative to the main body.

10. The mechanism of claim 9 wherein the swashplate handle member includes a shaft and at least one actuating arm extending from the shaft.

11. The mechanism of claim 10 wherein the swashplate handle member has two curved actuating arms extending from the shaft in a wishbone-shaped arrangement.

12. The mechanism of claim 11 wherein the swashplate handle member has a spring stop protruding radially outward from the shaft perpendicular to the actuating arms, said spring stop being engaged by the spring.

13. The mechanism of claim 12 wherein the spring stop on the swashplate handle member is located adjacent a junction of the shaft and the actuating arms.

14. The mechanism of claim 9 wherein the swashplate handle member has a spring stop protruding therefrom and the swashplate main body includes first and second spaced spring stops thereon for engaging the spring.

15. The mechanism of claim 14 wherein the spring includes first and second coiled compression springs, the first spring being located between the first spring stop on the swashplate main body and the spring stop on the swashplate handle member, the second spring sharing a common central longitudinal axis with the first spring and being located between the second spring stop on the main body and the spring stop on the handle member, whereby the first and second springs bias the handle member into a given angular position relative to the main body.

16. The mechanism of claim 9 wherein the swashplate has a pair of spaced passages beginning at the slipper running surface and intersecting the spool bore, said passages being angularly spaced on the slipper running surface so that one of the pair of passages is in fluid communication with the fluid passage of a leading piston assembly while the other passage of the pair of passages is in fluid communication with the fluid passage of a trailing piston assembly.

17. The mechanism of claim 9 wherein the variable orifice includes a spool bore formed in the swashplate main body, a spool slidably disposed in the spool bore so as to selectively and adjustably open a passage between the fluid passage of a leading piston assembly and the fluid passage of a trailing piston assembly.

18. The mechanism of claim 17 wherein the spool bore is disposed radially outward of and perpendicular to the slipper running surface.

19. The mechanism of claim 17 wherein the spool bore is a blind bore delimited by a bottom wall that supports a spring located below the spool for urging the spool toward the actuating arm.

20. The mechanism of claim 12 wherein the spring includes first and second coiled compression springs; the first spring being located between the first spring stop on the swashplate main body and the spring stop on the swashplate handle member, the second spring sharing a common central longitudinal axis with the first spring and being located between the second spring stop on the main body and the spring stop on the handle member, whereby the first and second springs bias the handle into a given angular position relative to the main body; the variable orifice including a pair of spool bores in the swashplate main body registered with the actuating arms, a pair of spools each axially slidable in each one the spool bores, and a spring for urging each of the spools into engagement with one of the actuating arms respectively.

21. A method of adjusting swashplate moments in a multiple piston hydrostatic unit comprising the steps of:

providing a fluid passage in the swashplate so as to selective fluidly connect a leading piston and a trailing piston;

providing a variable orifice in said fluid passage;

adjusting the size of the variable orifice connecting the leading piston and the trailing piston based upon a control error signal.

22. A swashplate position assist mechanism for a hydrostatic unit including a rotatable cylinder block assembly with a plurality of piston bores therein and a corresponding plurality of piston assemblies each including a slipper attached to a piston that axially reciprocates in one of the plurality of piston bores, a fluid passage extending through each of the piston assemblies, the mechanism comprising:

a swashplate assembly including a swashplate main body having a hole therein extending along a tilt axis and a swashplate handle member rotatably journaled in the hole and coupled with the main body by a spring such that the main body rotates with the handle member about the tilt axis when a sufficient torque is applied to the handle member to overcome a predetermined biasing force imposed by the spring;

the swashplate main body having an annular slipper running surface thereon parallel to the tilt axis, a spool bore, and at least one orifice in fluid communication with the slipper running surface and the spool bore;

the swashplate handle member including a shaft and an actuator arm extending from the shaft;

said orifice having an opening area that is variable and controlled by a valve responsive to rotational movement of the handle member relative to the main body;

the valve including an elongated spool valve mounted for axial movement in the spool bore and adjustably connected to the actuator arm.

23. The mechanism of claim 22 comprising a pivotal attachment member including an elongated pin portion pivotally inserted into a hole in the actuator arm and a tab portion having an elongated slot therethrough extending transversely to a longitudinal axis of the pin portion.

24. The mechanism of claim 23 wherein the valve spool has a lower end disposed in the spool bore and an upper end with a threaded tang thereon extending through the slot in the pivotal attachment member, the tang being adjustably connected to the pivotal attachment member by lockable fastening so as to permit the tang to slide longitudinally in the slot of the pivotal attachment member when the actuating arm rotates in conjunction with the swashplate handle member.

25. The mechanism of claim 24 wherein the tang has a pair of opposing and parallel planar sides.

* * * * *